United States Patent [19]

Pendill

[11] Patent Number: 5,029,726

[45] Date of Patent: Jul. 9, 1991

[54] HEALTH CARE PRODUCT DISPENSER

[76] Inventor: Ross D. Pendill, 1208 Cranford Pl., Greeley, Colo. 80631

[21] Appl. No.: 517,157

[22] Filed: May 1, 1990

[51] Int. Cl.[5] ..... G07F 11/62

[52] U.S. Cl. ..... 221/69; 221/2; 206/538; 220/343

[58] Field of Search ..... 49/386, 388; 116/308; 206/528, 532, 534, 538, 540, 459, 815, 828, 45.13, 45.23; 220/336, 337, 340, 343; 221/2, 69

[56] References Cited

U.S. PATENT DOCUMENTS

| | | | |
|---|---|---|---|
| 1,300,528 | 4/1919 | Weeks | 220/337 X |
| 3,057,473 | 10/1962 | Stern et al. | 206/459 X |
| 3,127,048 | 3/1964 | Winter | 220/337 |
| 3,278,010 | 10/1966 | Katz | 206/534 |
| 4,039,080 | 8/1977 | Cappuccilli | 206/534 |
| 4,473,156 | 9/1984 | Martin | 206/534 |
| 4,649,813 | 3/1987 | Kehl | 220/337 X |
| 4,744,492 | 5/1988 | Hackmann et al. | 206/540 X |
| 4,793,492 | 12/1988 | Halbich | 206/538 |
| 4,899,237 | 12/1989 | Brandon | 206/538 X |
| 4,958,736 | 9/1990 | Urheim | 206/538 X |

*Primary Examiner*—Robert P. Olszewski

*Assistant Examiner*—Dean A. Reichard

*Attorney, Agent, or Firm*—Donald W. Margolis; Emery L. Tracy

[57] ABSTRACT

A health care product dispenser is provided which includes a base which is designed and adapted to be mounted in a substantially vertical orientation, and which further includes one or more normally closed combined holder and dispenser pockets which are designed and adapted to release one or more health care product by gravity discharge. In the preferred embodiment of the present invention, the holding and dispensing element is integral to the front surface of the base and protrudes therefrom. The holding and dispensing element may be comprised, for example, of a pair of parallel sidewalls which project from the base, a bottom wall which normally slopes downward, for example, away from the base, and a normally closed gate which is opposed to the base and positioned to normally close the sidewalls and complete an open pocket holder and dispenser in which health care products are placed to be retrieved by gravity feed. A mechanism is provided which allows the opening of the normally closed gate to allow any article which is therein to be gravity discharged.

19 Claims, 2 Drawing Sheets

HEALTH CARE PRODUCT DISPENSER

BACKGROUND OF THE INVENTION a) Field of the Invention

This invention relates to a system and process for dispensing health care products. More specifically it relates to the dispensing of health care products, and especially solid health care products, from a wall mounted system by gravity discharge.

b) Discussion of the Prior Art

In the dispensing of medication and other health care products, there is a universally recognized problem of getting the prescribed amount of product to the recipient at the correct times. In many instances, if medication is not taken, or is taken at the wrong times, or is taken in an improper dosage, the medication may not function as prescribed or required. Such failures can be dangerous, and perhaps even fatal. The problem of taking or giving the correct medication at the right time is difficult for many people, and they quite often forget to take or to give medication at the proper times. This can be a particular problem for elderly people whose memory is not what it once was, or for any person required to take or to give multiple or different medications during the course of the day, and day in and day out.

Medication, particularly antibiotics, are of the greatest benefit, if they are taken at the prescribed intervals and in the prescribed amounts, for the prescribed period of time. Typically, a user who is to take a medication at four hour intervals, takes the medication at intervals of from two hours to eight hours. Often, as a patient begins to feel better, the medication is not taken at all. The patient may then relapse if all of the medication has not been taken. Consequently, it can be seen that there is a need to provide an apparatus and a method to prevent this situation.

In addition to the need to be able to control the dosage of medication and the time for taking such medication, there is also the problem of limiting access to the medication by infants and children. Infants and children can often get access to medication stored in drawers or cabinets, or even those placed on top of cabinets or dressers. For a child too young to know that medication is dangerous, access to that medication should be prevented.

The prior art solutions to aforementioned problems are shown generally by Graves U.S. Pat. No. 4,204,611 issued on May 27, 1980; Messer U.S. Pat. No. 4,573,580 issued on Mar. 4, 1986; Helbich U.S. Pat. No. 4,793,492 issued on Dec. 27, 1988; Denney U.S. Pat. No. 4,749,085 issued on June 7, 1988; McLaughlin U.S. Pat. No. 4,717,042 issued on Jan. 5, 1988; and Christiansen U.S. Pat. No. 4,763,810 issued on Aug. 16, 1988. Graves U.S. Pat. No. 4,204,611 shows an apparatus for manually and chronologically dispensing tablets which is designed to sit horizontally on top of a flat surface. U.S. Pat. Nos. 4,573,580 and 4,793,492 and 4,749,085, teach compartmented pill dispensers with individual covers which are designed to control intake and to prevent overdoses. These dispensers, however, cannot be mounted vertically, and do not have a gravity discharge system for dispensing the medication. U.S. Pat. No. 4,749,085 teaches a medication dispenser with individual compartments which can be marked to show the time to take the medication, but as with the other above mentioned art, this patent can neither be mounted vertically, and does not have a gravity discharge system for dispensing the medication. U.S. Pat. Nos. 4,717,042 and 4,763,810 teach medical dispensers with compartments and timers. These dispensers are not capable of vertical mounting and are very complicated and expensive.

Other prior art which discloses medication dispensers includes Moe U.S. Pat. No. 3,618,559 issued on Nov. 9, 1971; Helbich U.S. Pat. No. 4,084,695 issued on Apr. 18, 1978; and Keffeler U.S. Pat. No. 4,372,445 issued on Feb. 8, 1983.

It is thus seen that it would be desirable to have a simple and inexpensive system for dispensing health care products which can be mounted vertically, and while in that position, selectively opened for a gravity discharge of the medication.

SUMMARY OF THE INVENTION

In view of the foregoing, it is an object of the present invention to provide a simple system for dispensing health care products.

It is another object of the present invention to provide such a system which is capable of being mounted on a substantially vertical surface.

Another object of the present invention is to provide a substantially vertically mounted system for dispensing health care products, which system is inexpensive, simple in construction and design, and which utilizes gravity discharge to dispense the health care products.

The foregoing objects of the present invention are obtained by providing a health care product dispenser which is capable of being mounted on a substantially vertical surface, such as a wall, and which is designed to hold and release the health care product by use of a mechanical dispenser, and through gravity discharge. The dispenser includes a base which is designed and adapted to be secured to a substantially vertical surface. The health care product dispenser of the present invention also includes one or more normally closed combined holding and dispensing pocket which is designed and adapted to release one or more health care product by gravity discharge. The holding and dispensing means comprises a holding pocket and a vertical gravity discharge mechanism. In use, one or more health care product is placed in the holding and dispensing pocket to be retrieved at later time periods.

In the preferred embodiment of the present invention, the holding and dispensing element is integral to the base and protrudes therefrom. The holding and dispensing element may be comprised, for example, of a pair of parallel sidewalls which project from the base, a bottom wall which normally slopes downward, for example, away from the base, and a normally closed gate which is opposed to the base and positioned to normally close the sidewalls and complete an open pocket holder and dispenser in which health care products are placed to be retrieved, for example, at some set time, by a user by gravity feed. A mechanism is provided which allows the opening of the normally closed gate to allow any article which is therein to be gravity discharged.

In its preferred embodiment, the gate of the holding and dispensing pocket includes a pair of flanges which are designed and adapted to be positioned adjacent the sidewalls. The flanges are pivotally connected to the sidewalls, and a biasing device is provided to normally hold the gate in a closed position between the sidewalls and across the bottom wall. The pivotal arrangement of the gate is such that upon the exertion of inward pressure at a certain point on the front of the gate, the gate is caused to pivot upward creating a space between the bottom of the gate and the front of the sloping bottom wall, thereby allowing any article in the holding and dispensing pocket to slide downward off of the sloping bottom wall and out of the holding and dispensing pocket by gravity discharge.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
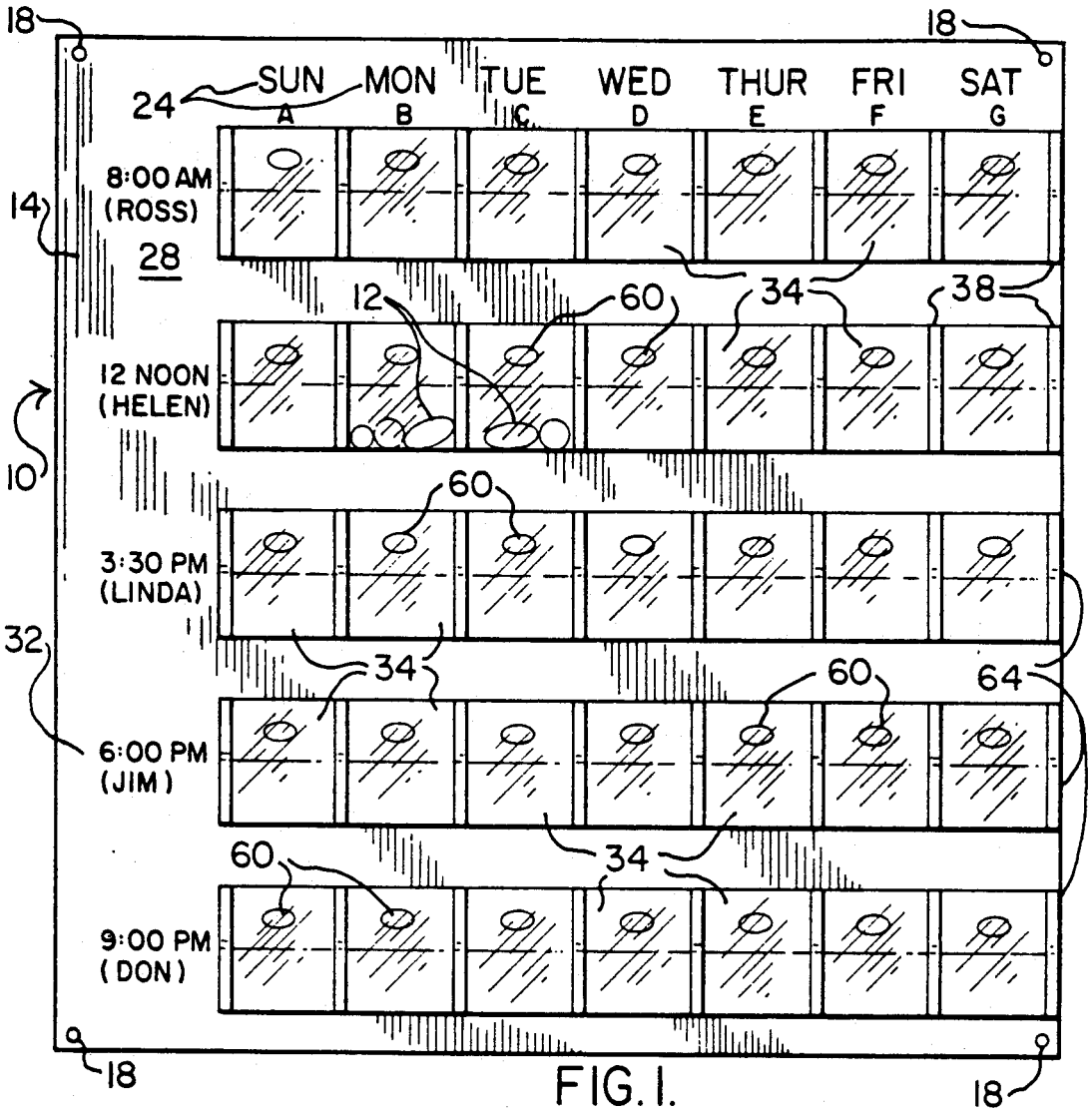
FIG. 1 is a front view of the health care product dispenser of the present invention showing a base which is designed to be mounted on a vertical surface, and a matrix of holding and dispensing devices.
Figure 4:
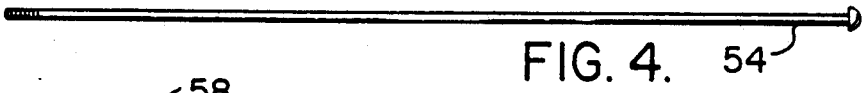
FIG. 4 is a side view of a pin which is used in making a pivotal connection for the gate of the health care product dispenser of the present invention.

Referring initially to FIG. 1, a preferred embodiment of the health care product dispenser of the present invention, designated generally as 10, is illustrated. Health care product dispenser 10 is primarily intended for use by one or more person who must take either many medical prescriptions or over the counter preparations at one time, or even a single prescription or preparation at several different times during the day. Dispenser 10 is designed to dispense health care products designated generally as 12. As used herein, health care products 12 include, but are not limited to, medical prescriptions, over the counter preparations, and even vitamins. They may be in the form of solid tablets, ampules, capsules, or the like, and an identifiable object can also be provided to be dispensed which will alert the user to take a liquid medication, a spray, or to receive or take some form of treatment.

Dispenser 10 includes a base 14 which is adapted to be mounted in a substantially vertical orientation, for example, on a substantially vertical surface, such as a wall or the side of a piece of furniture, although, it may be placed in its substantially vertical orientation by the use of a stand resting on a surface, not shown. When base 14 is mounted on a surface, such as a wall or the side of a piece of furniture, it can be located out of the reach of infants and children. Such mounting also deters the possibilities of tipping dispenser 10 or spilling its contents, and reduces counter or table top clutter. Base 14 is preferably rectangular, but any configuration may be utilized. Base 14 may be of plastic, wood or metal, although any type of workable solid material may be utilized for its construction.

Figure 2:
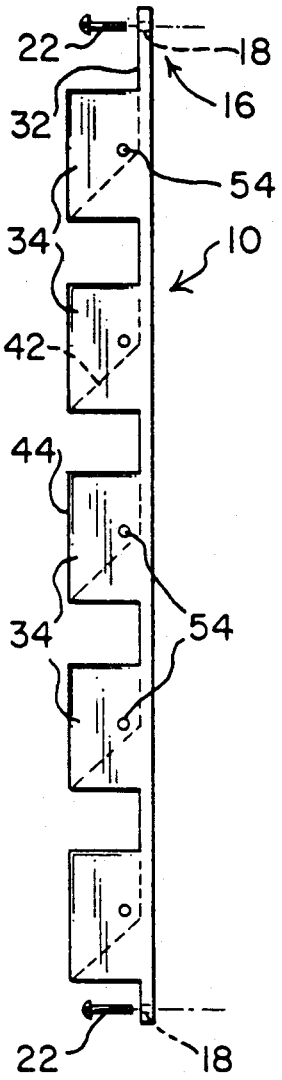
FIG. 2 is a side view of the health care product dispenser of FIG. 1, and showing a vertical row of holding and dispensing devices, including, in phantom, their downwardly sloping bottom walls.
Figure 5:
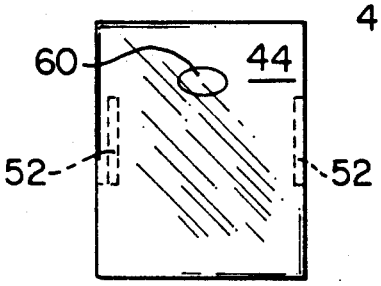
FIGS. 5–7 are an enlarged front view, left side view, and top view, respectively, of the gate of FIG. 3 which is used to close and open the holding and dispensing device of the present invention.
Figure 6:
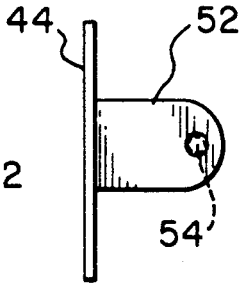
Figure 7:
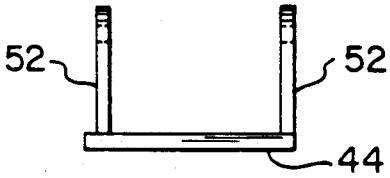

As shown in FIGS. 1 and 2, in the preferred embodiment base 14 includes a mechanism, generally 16, for mounting the system to a substantially vertical surface. In the example shown, mounting means 16 includes a mounting aperture 18 in each corner of base 14 through which a securing element such as bolts or screws 22, or even nails, tacks or staples can be passed to securely fasten base 14 in a substantially vertical orientation to a surface, not shown. Any other type of fastening or securing system may also be utilized for this purpose.

Referring once again to FIG. 1, the preferred embodiment of dispenser 10 includes both a horizontal file and a vertical file of dispensers, the structure of which are described in greater detail below. Base 14 is shown as carrying a series of indicia 24 spaced horizontally along the top of its front surface. Each of indicia 24 are representative of the days of the week in calendar order, "Sun", "Mon", "Tues", etc., thereby indicating the day of the week on which the contents of the subordinate vertical file of dispensers should be taken. Other suitable horizontal indicia 24 can be used, as designated by "A", "B", "C", etc., for example, such as the name of the specific health care product.

In a similar manner, space 28 located along side 32 of base 14 may be utilized to carry indicia which indicates either times during the day at which medication should be taken, the type of medication, a user's name, if more than one person is utilizing dispenser 10. To provide easy-to-read information, the indicia should, preferably contrast with the base, and may be in varying colors, and be embossed or raised in relief. Additionally, the indicia may appear in conventional characters as well as in braille, and can be made of different size type to make it easier for persons of reduced eyesight to find the necessary information.

Dispenser 10 also includes at least one device for holding and dispensing articles, designated generally as 34. Referring now to FIGS. 3 and 5–7, holding and dispensing devices 34 are shown as, and preferably are, integral with base 14, protruding outward from the front surface thereof. Holding and dispensing devices 34 includes a pair of parallel sidewalls 38 which project from the front surface of base 14 and a bottom wall 42. In preferred embodiments, bottom wall 42 slopes downward away from base 14. Holding and dispensing devices 34 also includes a normally closed gate 44 which is opposed to the base 14. Gate 44 is positioned to normally close the space between sidewalls 38, thereby defining an open pocket holder and dispenser in to which health care products may be placed to be retrieved by a user at a future time, as described below.

Gate 44 is preferably pivotally attached to sidewalls 38. A pair of parallel opposed flanges 52 are carried by gate 44. Flanges 52 are preferably integral with gate 44. As shown, flanges 52 are pivotally positioned within sidewalls 38. As seen in FIG. 2, a pivotal connection pin 54 may be used to secure flanges 52 of gate 44 to sidewalls 38. However, any other type of pivotal connection may be utilized for this purpose.

Gate 44 is preferably manufactured of transparent material so that the contents 12 of each holding pocket structure 34 can be seen without opening or otherwise entering that pocket. The embodiments of holding and dispensing devices 34 described above and illustrated in the drawings may be made of plastic or other suitable material.

Figure 9:
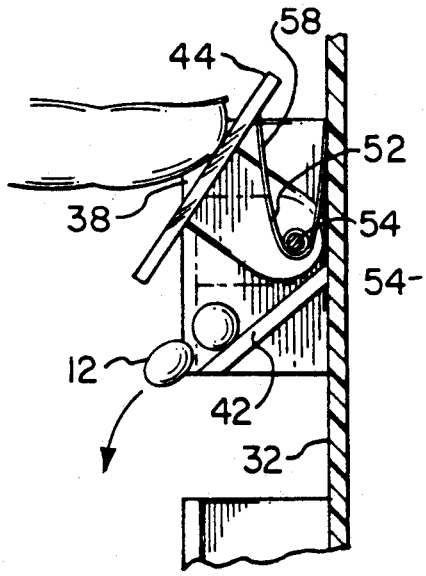
FIGS. 8 and 9 are an enlarged broken away front view and side view taken along line 9—9 in FIG. 8, respectively, of the holding and dispensing devices of FIG. 3, showing the gate being caused to pivot upward to allow medication to be dispensed through the resulting opening.
Figure 8:
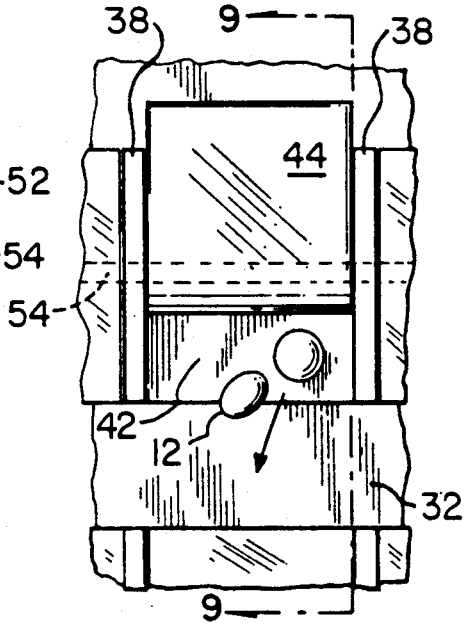

A biasing device 58, such as a spring, is provided for biasing gate 44 into a normally closed position against the front edge of sloping bottom wall 42 to maintain holding and dispensing device 34 in a normally closed position. However, utilizing this mechanism, gate 44 can be easily opened to remove articles 12. This is accomplished by exerting inward pressure at a point on the front of gate 44 above the pivotal connection of flanges 52 to sidewalls 38. The preferred point for the exertion of such inward pressure has been designate as 60, and is preferably marked on the front of gate 44. Now referring to FIGS. 8 and 9, as inward pressure is exerted on or about mark 60, gate 44 will pivot outward at its bottom. This creates a space between the bottom of gate 44 and the front of bottom wall 42, thereby allowing any health care products 12 which are in holding pocket 34 to slide downward and outward by gravity discharge along bottom wall 42.

It is thus seen, that utilizing the present invention, health care products may be easily and accurately withdrawn since there is no necessity for the patient to insert his or her fingers into the holding pocket structure to remove the pills or other medication. This is particularly desirable when the dispenser is used by elderly or arthritic patients.

Figure 3:
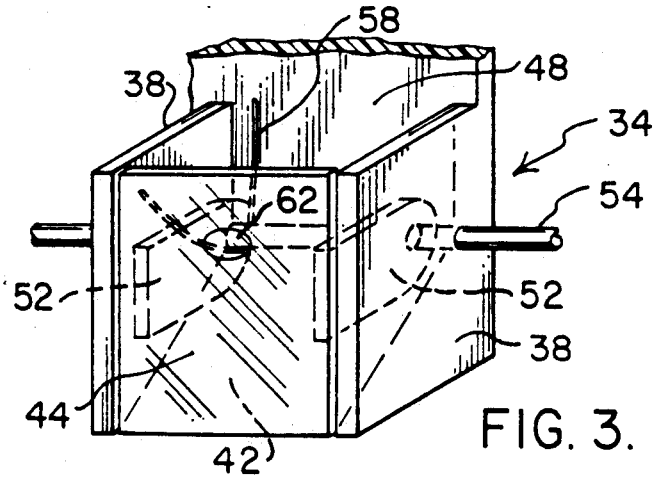
FIG. 3 is an enlarged broken away perspective view, partially in phantom, showing in detail, a single holding and dispensing device, including a gate, which is included in the health care product dispenser of FIG. 1.

Biasing device 58 is preferably in the form of a loop spring, although any type of spring or other biasing member may be utilized for this purpose. Spring 58 preferably has a tension of approximately three to five ounces. When pressure is removed from the front of gate 44 at or around mark 60, biasing device 58 causes gate 44 to rotate back to its normally closed position, as shown in FIG. 3.

Dispenser 10 is designed in such a manner that articles 12 can be discharged into a user's hand, a spoon, a cup or any other container which is suitable for holding health care products 12 prior to their consumption. Any type of container, which is convenient for use by the patient, may be utilized to receive the discharged object. As previously noted, article 12 may be an identifiable object which will alert the patient to take a liquid medication, or a spray, or to receive or take some form of treatment.

As previously noted, in the preferred embodiment of the present invention, base 14 is designed to include several files of both vertical and horizontal holding and dispensing pocket structures 34. It will be apparent that the number of pocket structures 34, as well as their relative disposition and size can be varied. However, for practical reasons, the preferred distribution of holding pocket structures 34 are such that they are arranged in a vertical row, in a manner such that sidewalls 38 of each holding pocket structure 44 are substantially aligned with each one another. In addition, base 14 is further designed to include a plurality of holding pockets 34, in a horizontal file. Together, the vertical and horizontal files form a matrix 64 of holding and dispensing pockets 34 which are capable of holding, for example, an entire week's supply of one persons health care products. Holding and dispensing pockets 34 are open at the top, and allow the user to place articles 12 into each holding and dispensing pocket 34, without removing dispenser 10 from the vertical surface or stand which supports it, by using fingers, spoons, forceps, funnels or other instruments.

In the preferred embodiment, the vertical files of holding and dispensing pockets 34, which form a portion of matrix 64 are aligned with indicia 24 in a manner such that each vertical file is aligned under one of the indicia 24. As mentioned previously, each of these indicia 24 preferably indicates a different day of the week. This allows a patient to store up to an entire week's supply of medication or other health care products with each separate day of the week clearly indicated over each vertical file. By providing more than one horizontal file of holding and dispensing pocket structures 34, a user may identify each horizontal file in a manner such that the user may be able to either mark on space 32 the different times of the day the health care product is taken, and/or the different types of health care products to be taken at those different times, or another person's medication in the same dispenser.

The dispenser 10 according to the present invention increases the possibilities of the patient to adhere to the doctor's prescription and makes it possible for doctors or relatives to check that the prescription dosage is strictly followed. The risk of a double intake of medical prescriptions or over the counter medication is highly reduced, as already mentioned, and the risk that another doctor than he who made the original prescription will prescribe synonymous preparations or such preparations as can lead to unfavorable effects in connection with those already prescribed, is eliminated because the prescription is already within dispenser 10 for easy viewing of contents. The dispenser 10 according to the present invention is not only for use by old patients and others who can adhere only with difficulty to the conventional medication prescribed, but also for any person wishing to utilize an easy and convenient way to dispense medications.

It is therefore seen that the present invention provides a simple device for dispensing health care products. The system is simple in construction and design and lends itself to being mounted to a substantially vertical surface. Furthermore the present invention provides a simple, inexpensive system for dispensing solid health care products, and one in which the system is capable of being mounted on a substantially vertical surface, and in which further, utilizes gravity discharge to dispense the solid health care products.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A health care product dispenser including, in combination:

a base member, said base member being designed and adapted to be mounted in a substantially vertical orientation, said base having a front surface; and at least one normally closed means for holding and dispensing health care products, said health care product holding and dispensing means being secured to said front surface of said base, each of said health care product holding and dispensing means being openable and designed and adapted, when opened and when said base is in a substantially vertical orientation, to release any such health care products which it may carry by gravity discharge.

2. The dispenser as defined in claim 1, wherein there are two or more health care product holding and dispensing means carried on said front surface of said base, and wherein further there is an individual indicia arranged in an array relative to substantially each of said health care product holding and dispensing means.

3. The dispenser as defined in claim 2, wherein said indicia provides information selected from the group consisting of time of use, day of use, health care product, and user.

4. The dispenser as defined in claim 3, wherein said means for holding and dispensing health care products are arrayed in a substantially horizontal file across said front surface of said base in a series, and wherein individual indicia of said array of indicia each designate a different day of the week.

5. The dispenser as defined in claim 3, wherein said means for holding and dispensing health care products are arrayed in a substantially vertical file on said front surface of said base, and wherein individual indicia of said array of indicia each designate a different time of day.

6. The dispenser as defined in claim 3, wherein some of said means for holding and dispensing health care products are arrayed in a substantially horizontal file and wherein some of said means for holding and dispensing health care products are arrayed in a substantially vertical file to form a matrix of health care product holding and dispensing means on said front surface of said base, and wherein further, there is a series of substantially horizontal indicia, each horizontal indicia being proximate one such substantially vertical file, and designating a day of the week, and there is a series of substantially vertical indicia, each vertical indicia being proximate one such substantially horizontal file, and designating a time of the day.

7. The dispenser as defined in claim 6, wherein at least some of said indicia are selected and provided by the user.

8. The dispenser as defined in claim 2, wherein at least some of said indicia are selected and provided by the user.

9. The dispenser as defined in claim 1, wherein said means for holding and dispensing health care products protrudes from said front surface of said base, said means for holding and dispensing health care products being comprised of a pair of parallel sidewalls which project from the base, a bottom wall, and a normally closed gate which is opposed to the base and positioned to normally close the space between said sidewalls and said bottom wall to thereby complete an open pocket holder and dispenser in which health care products may be placed to be retrieved by gravity feed.

10. The dispenser as defined in claim 9, wherein said means for holding and dispensing health care products is integral with said front surface of said base.

11. The dispenser as defined in claim 9, wherein said bottom wall slopes downward.

12. The dispenser as defined in claim 9, wherein said bottom wall slopes away from said front surface of said base.

13. The dispenser as defined in claim 9, wherein a means for opening of the normally closed gate are provided to thereby allow any article which is therein to be gravity discharged when said gate is opened and when said base is in a substantially vertical orientation with said bottom wall down.

14. The dispenser as defined in claim 9, wherein a biasing means is associated with said gate in such a manner that the bottom of said gate is normally biased against said bottom wall, but in which the exertion of inward force at a point on the front of said gate will cause the bottom of said gate to pivot upward to create a space between the bottom of said gate and said bottom wall, said space being of sufficient area to allow any to-be-dispensed item in said pocket to slide out of the said pocket.

15. A solid health care product dispenser comprising:

a base adapted to be mounted in a substantially vertical orientation, said base having a front surface;

at least one means for holding and dispensing solid health care products, said holding and dispensing means being integral to said base and protruding outward from said front surface of said base, said holding and dispensing means being comprised of a pair of spaced apart sidewalls and a normally downward sloping bottom wall, said bottom wall sloping away from front surface of said base, and further including a normally closed gate, said gate carrying a pair of spaced apart flanges which pivotally connected to said sidewalls, thereby together forming a holding pocket structure whereby health care products may be placed in to said holding pocket;

a means for biasing said gate into a normally closed position against said sloping bottom wall, said biasing means being designed and located in such a manner that the exertion of inward pressure at a certain point on the front of said gate will cause the bottom of said gate to pivot upward to create a space between the bottom of said gate and said sloping bottom wall, thereby allowing anything in said holding means to slide downward off of said sloping bottom wall and out of the said holding pocket.

16. The dispenser as defined in claim 15, wherein some of said means for holding and dispensing health care products are arrayed in a substantially horizontal file and wherein some of said means for holding and dispensing health care products are arrayed in a substantially vertical file to form a matrix of health care product holding and dispensing means on said front surface of said base, and wherein further, there is a series of substantially horizontal indicia, each horizontal indicia being proximate one such substantially vertical file, and designating a day of the week, and there is a series of substantially vertical indicia, each vertical indicia being proximate one such substantially horizontal file, and designating a time of the day.

17. A health care product dispenser including, in combination:

a base member, said base member being designed and adapted to be mounted in a substantially vertical orientation, said base having a front surface; and at least one normally closed means for holding and dispensing health care products, said health care product holding and dispensing means being secured to and protruding from said front surface of said base, and integral with said front surface of said base, said health care product holding and dispensing means being comprised of:

a. a pair of parallel sidewalls which project from said base;

b. a bottom wall; and c. a normally closed gate which is opposed to said base and positioned to normally close the space between said sidewalls and said bottom wall, said gate being designed and adapted, when closed to block the area between said sidewalls and said bottom wall, said gate further including a pair of spaced apart flanges, each said flange being designed and adapted to be pivotally connected to one of said sidewalls in such a manner that said gate can pivot away from said bottom wall to thereby complete an open pocket holder and dispenser in which health care products may be placed to be retrieved by gravity feed; whereby, when said health care product holding and dispensing means is opened and when said base is in a substantially vertical orientation, any such health care products which it may carry will be released by gravity discharge.

18. The dispenser as defined in claim 17 wherein said bottom wall slopes away from said front surface of said base, and wherein as inward pressure is exerted above the pivotal connection of said flanges to said sidewalls said gate will pivot outward away from said bottom wall to thereby create a space between the bottom of said gate and said bottom wall so that any contents within said pocket may slide downward and outward from said pocket by gravity feed along said sloped bottom wall when said base is in a substantially vertical orientation with said bottom wall down.

19. The dispenser as defined in claim 17 wherein said bottom wall slopes away from said front surface of said base, and wherein there is an indicia located on said gate above the pivotal connection of said flanges to said sidewalls, whereby, as inward pressure is exerted upon said indicia the bottom of said gate will pivot outward away from said bottom wall to thereby create a space between the bottom of said gate and said bottom wall so that any contents within said pocket may slide downward and outward from said pocket by gravity feed along said sloped bottom wall when said base is in a substantially vertical orientation with said bottom wall down.

* * * * *